US008353741B2

(12) United States Patent
Fowler, III

(10) Patent No.: US 8,353,741 B2
(45) Date of Patent: Jan. 15, 2013

(54) SYSTEM AND METHOD FOR REMOVING A COATING FROM A SUBSTRATE

(75) Inventor: John L. Fowler, III, Shawnee, KS (US)

(73) Assignee: All Coatings Elimination System Corporation, Kansas City, MO (US)

( * ) Notice: Subject to any disclaimer, the term of this patent is extended or adjusted under 35 U.S.C. 154(b) by 611 days.

(21) Appl. No.: 12/552,976

(22) Filed: Sep. 2, 2009

(65) Prior Publication Data

US 2011/0053464 A1 Mar. 3, 2011

(51) Int. Cl.
*B24B 1/00* (2006.01)

(52) U.S. Cl. ..... 451/38; 451/39; 451/101

(58) Field of Classification Search ..... 451/38, 451/39, 40, 90, 91, 101
See application file for complete search history.

(56) References Cited

U.S. PATENT DOCUMENTS

| | | | | |
|---|---|---|---|---|
| 1,966,571 | A | 7/1934 | Webb | |
| 2,114,573 | A | 4/1938 | Rhodes | |
| 3,828,478 | A * | 8/1974 | Bemis | 451/90 |
| 3,994,097 | A | 11/1976 | Lamb | |
| 4,044,507 | A * | 8/1977 | Cox et al. | 451/38 |
| 4,125,696 | A | 11/1978 | Kamath | |
| 4,369,607 | A | 1/1983 | Bruggeman et al. | |
| 4,412,402 | A | 11/1983 | Gallant | |
| 4,517,774 | A | 5/1985 | Dudding | |
| 4,548,001 | A | 10/1985 | Link | |
| 4,666,083 | A | 5/1987 | Yie | |
| 4,689,923 | A | 9/1987 | Goudeaux et al. | |
| 4,709,515 | A | 12/1987 | Copeland et al. | |
| 4,768,314 | A | 9/1988 | Thompson | |
| 4,768,709 | A | 9/1988 | Yie | |
| 4,802,312 | A | 2/1989 | Glaeser et al. | |
| 4,827,680 | A | 5/1989 | Rushing et al. | |
| 4,845,903 | A | 7/1989 | Woodward | |
| 4,878,320 | A | 11/1989 | Woodson | |
| 4,922,664 | A | 5/1990 | Spinks et al. | |
| 5,035,090 | A | 7/1991 | Sziics | |
| 5,054,249 | A | 10/1991 | Rankin | |
| 5,123,206 | A | 6/1992 | Woodson | |
| 5,201,150 | A | 4/1993 | Kuboyama et al. | |
| 5,308,404 | A | 5/1994 | Yam et al. | |
| 5,637,030 | A * | 6/1997 | Chopra et al. | 451/39 |
| 6,168,503 | B1 * | 1/2001 | Pao et al. | 451/40 |
| 6,390,899 | B1 * | 5/2002 | Loubeyre | 451/90 |
| 6,609,955 | B1 * | 8/2003 | Farrow | 451/38 |
| 2003/0203707 | A1 * | 10/2003 | Farrow | 451/38 |
| 2005/0003747 | A1 * | 1/2005 | Dore | 451/90 |
| 2006/0223423 | A1 * | 10/2006 | Dorfman et al. | 451/38 |
| 2007/0155289 | A1 * | 7/2007 | Miller | 451/38 |
| 2007/0207713 | A1 * | 9/2007 | Farrow | 451/75 |
| 2010/0167631 | A1 * | 7/2010 | Farrow | 451/91 |

* cited by examiner

FOREIGN PATENT DOCUMENTS

| | | |
|---|---|---|
| GB | 2344348 | 6/2000 |
| GB | 2372039 | 8/2002 |

*Primary Examiner* — Maurina Rachuba
(74) *Attorney, Agent, or Firm* — Hovey Williams LLP

(57) ABSTRACT

A system and a method for removing a coating from a substrate. The system provides a compressed air source, a heated water source, a particulate cleaning medium source, and a mixing valve including an air input, a water input, and a particulate cleaning medium input. The inputs are positioned on the valve so that the water input is positioned downstream of the compressed air input, and the particulate cleaning medium input is positioned downstream of both the compressed air and water inputs. The method of mixing the air, water, and particulate cleaning medium provides a coating removal mixture having a volumetric ratio of air to water of at least 100:1 and a volumetric ratio of air to particulate cleaning medium of at least 70:1.

25 Claims, 4 Drawing Sheets

SYSTEM AND METHOD FOR REMOVING A COATING FROM A SUBSTRATE

BACKGROUND

1. Field of the Invention

Embodiments of the present invention are generally directed to a system and method for removing a coating from a substrate.

2. Description of the Related Art

Systems and methods for removing a coating from a substrate, such as a wall, building, fence, etc., are well-known. A common system for removing a coating is a dry sandblaster. The typical sandblaster operates by projecting a pressurized stream of air of 150 psi and sand, such as silica, against the substrate so as to chisel the coating off the substrate. Generally, dry sandblasters are only used on hard substrates, such as steel and concrete. When used on less durable substrates the sandblaster often does more harm than good. If care is not taken to properly use the sandblaster, including an appropriate pressure amount for the substrate, the sandblaster will remove not only the coating but also portions of the substrate. Conversely, if too little pressure is used, the sandblaster fails to remove the coating. Moreover, use of a sandblaster often leaves unwanted sand residue around the area being cleaned due to the large quantities of cleaning medium consumed. A typical dry sand blaster consumes around 440 pounds of cleaning medium per hour. Dry sandblasters also generate harmful dust, requiring breathing protection be worn by the operator at all times when in use. Damage to the substrate by dry sandblasting can be reduced by varying the type of cleaning medium to a more gentle alternative than sand, but dust generation is still a primary hazard.

An alternative to harmful dry sandblasters is a wet sandblaster. A wet sandblaster employs water as the carrier to move the cleaning media from the cleaning medium source into the pressurized air stream. The water eliminates the dust hazards associated with dry sandblasting and can also reduce damage to the substrate. An average wet sandblaster using a 185 cfm air compressor consumes about 300 pounds of cleaning medium and 60 gallons of water per hour, producing a cleaning medium to water ratio of approximately 1:3. The defects in wet sandblasters are that spent wet cleaning medium is difficult and time consuming to remove from the job site. Additionally, the large volumes of water required demand that a source of water be present at the job site, provided by either a tap or a tanker.

Another system for removing a coating from a substrate is a high-pressure washer that deploys water or other cleaning fluid under high pressures of from 1500 psi to over 50,000 psi. Although the pressure washer does not employ sand, and therefore, limits the amount of damage that can be done to the substrate, the pressure washer still must be used carefully and only on substrates that again can withstand the pressures generated. Moreover, like the wet sandblaster, the pressure washer employs a large amount of water to accomplish the coating removal. Water consumption ranges from 120 to 600 gallons per hour, depending on the requirements of the washer. As with wet sandblasting, the large volumes of water consumed demand that a source of water be present at the job site. The high pressures also broadcast removed debris and waste water over surrounding areas. Therefore, use of the pressure washer in interior spaces is not preferred, as the waste water can possibly harm surrounding surfaces and be a nuisance to clean up.

Accordingly, there is a need for a system and a method for removing a coating from a substrate that does not rely on a large amount of water and/or a large amount of cleaning medium to accomplish the removal of the coating. Additionally, there is a need for a system and a method that can be used in locations where waste water outputted during operation is undesired. Moreover, there is a need for a system and a method operating at low pressures that can efficiently remove coatings with little or no damage to the substrate.

SUMMARY OF EMBODIMENTS OF THE PRESENT INVENTION

Embodiments of the present invention provide a low-pressure, environmentally-efficient system and method for removing a coating from a substrate. The system significantly reduces material waste, including water and a particulate cleaning medium, than prior art systems. Additionally, the system is low-pressure, which lessens the potential for harming a substrate being cleaned.

The system of embodiments of the present invention generally comprises a compressed air source for providing compressed air; a heated water source for providing heated water; a particulate cleaning medium source for providing a particulate cleaning medium; a mixing valve having a compressed air input coupled with the compressed air source, a heated water input coupled with the heated water source, a particulate cleaning medium input coupled with the particulate cleaning medium source and an output; a mixing chamber housed within the valve for mixing of the compressed air, the heated water, and particulate cleaning medium, so as to provide a coating removal mixture, the mixing chamber being fluidly connected to the compressed air input, the heated water input, the particulate cleaning medium input, and the output; and a nozzle coupled with the output for dispersion of the coating removal mixture onto the coating and substrate. The compressed air input, the water input, and the particulate cleaning medium input, are positioned on the valve such that the water input is positioned downstream of the compressed air input, and the particulate cleaning medium input is positioned downstream of both the compressed air and water inputs.

Embodiments of the present invention use significantly less water and particulate cleaning medium than prior art systems. For example, a volumetric ratio of air to water in the coating removal mixture is, in preferred embodiments, at least 150:1, and a volumetric ratio of air to particulate cleaning medium in the coating removal mixture is, in preferred embodiments, at least 200:1. This equates into a lower operating cost and a system that uses less natural resources, such as water.

DETAILED DESCRIPTION

Figure 1:
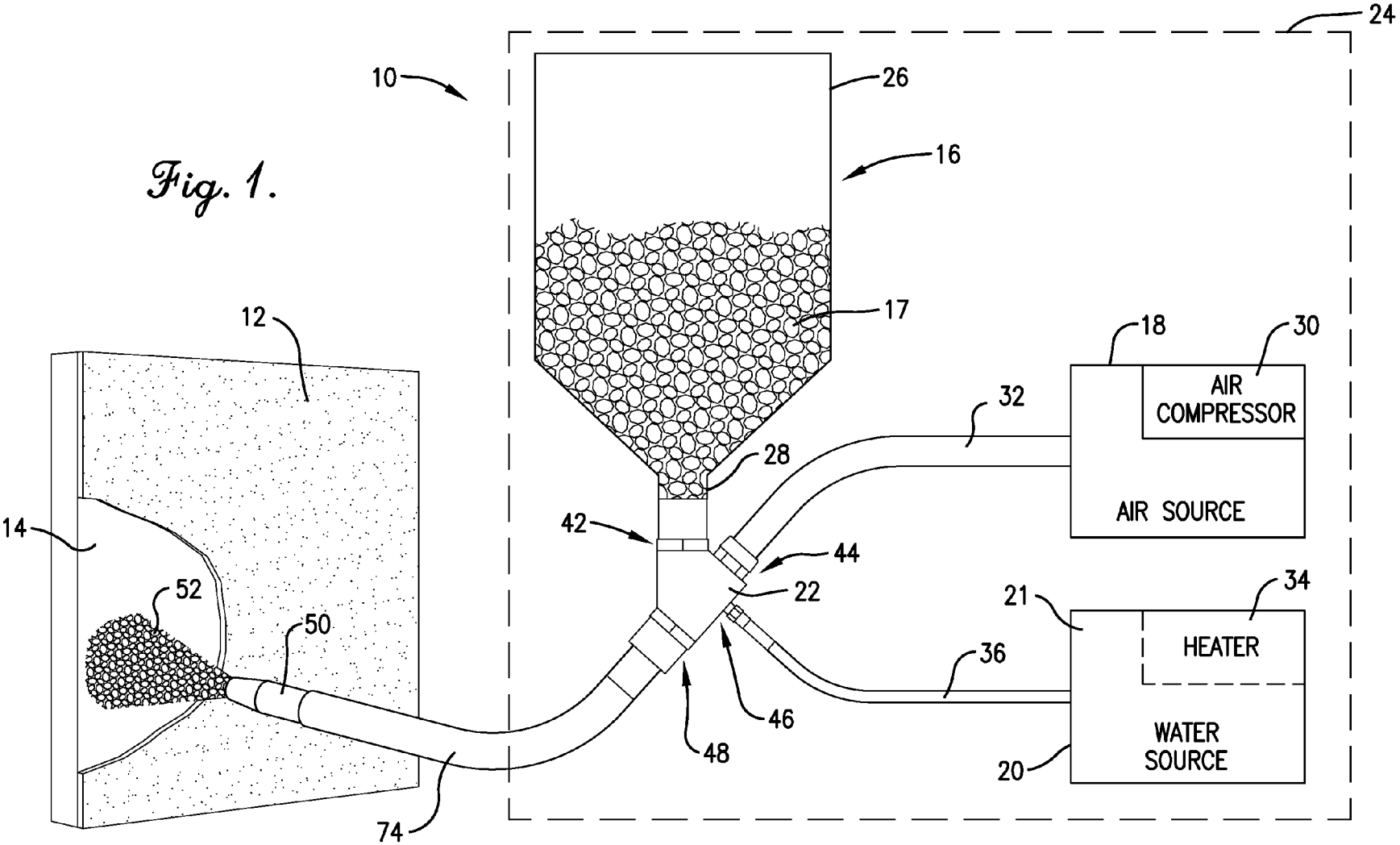
FIG. 1 is a schematic view of a system of embodiments of the present invention for removing a coating from a substrate.
Figure 5:
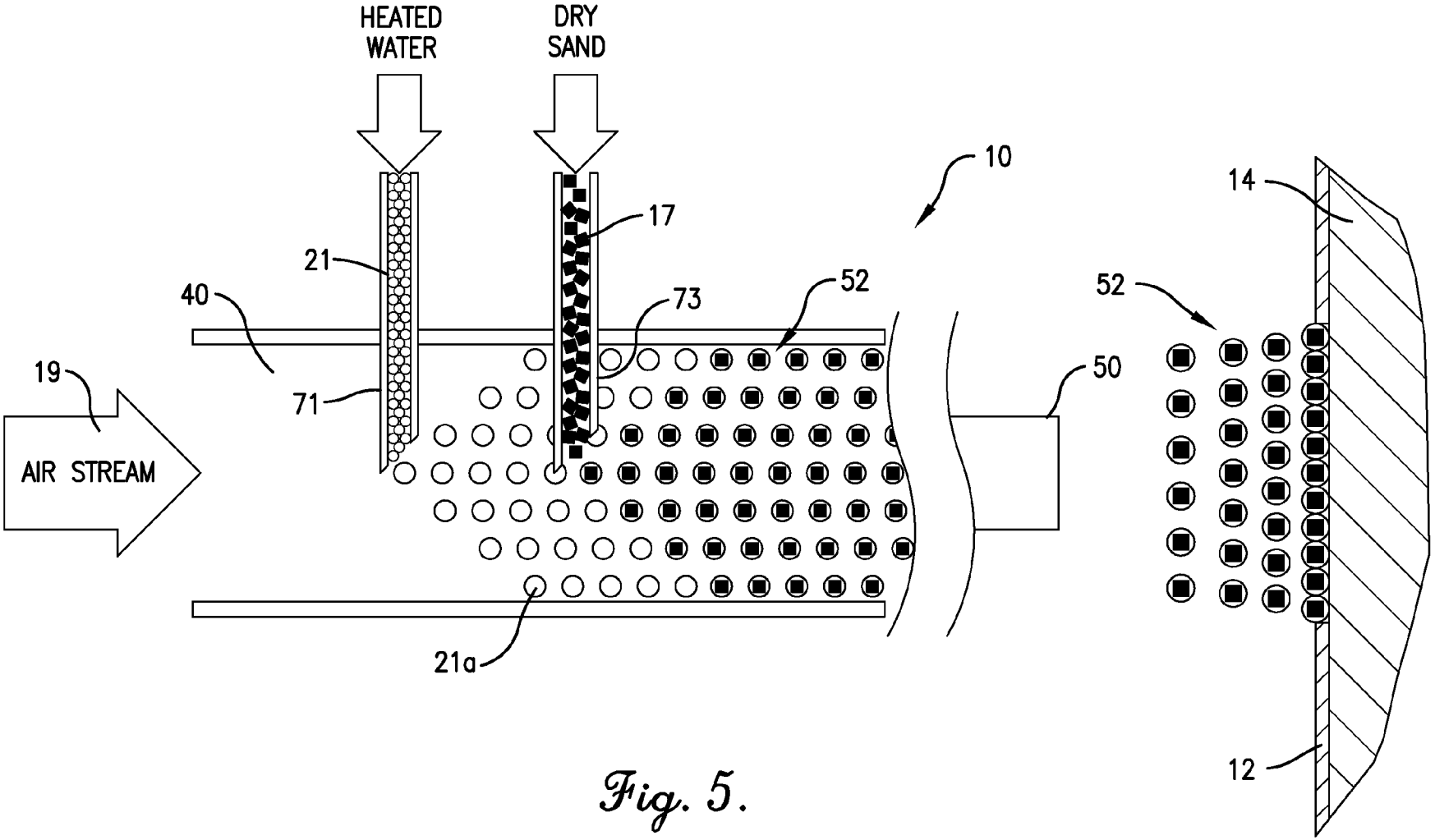
FIG. 5 is a conceptual view of a movement of compressed air, water, and a particulate cleaning medium through the valve of embodiments of the present invention.

Turning now to the drawing figures, and particularly FIGS. 1 and 5, a system 10 and a method for removing a coating 12 from a substrate 14 are illustrated. The system 10 comprises a particulate cleaning medium source 16 for providing a particulate cleaning medium 17, a compressed air source 18 for providing compressed air 19, a heated water source 20 for providing heated water 21, a mixing valve 22 coupled to the particulate cleaning medium source 16, the compressed air source 18, and the heated water source 20, and a frame 24 on which is mounted the particulate cleaning medium source 16, the compressed air source 18, the heated water source 20, and the mixing valve 22.

Referring to FIG. 1, the particulate cleaning medium source 16 preferably comprises a hopper 26 for storage of the particulate cleaning medium 17. The hopper 26 is preferably located at a higher elevation that the mixing valve 22 so that the particulate cleaning medium can be transferred from the hopper 26 to the mixing valve 22 by gravitational force, pressure, or a siphon. The particulate cleaning medium 17 used in the system 10 and method can be any medium formed of discrete solid particles capable of removing a coating from a substrate when contacted with the coating at a high velocity. The average particle size of the particulate cleaning medium 17 is preferably 50-250 micron (μ), more preferably 75-200μ, and most preferably 100-175μ.

In certain embodiments of the present invention, the particulate cleaning medium comprises a material selected from the group consisting of olivine, sodium bicarbonate, dry ice, sponge, plastic beads, glass beads, ceramic beads, jetmag, coal slag, garnet, aluminum oxide andalusite, spodumene, diaspore, congolite, spessartime, andsine, and combinations thereof. In certain circumstances, olivine may be a particularly advantageous cleaning medium because when olivine is contacted with heat and water, as described herein, the coating-removal efficiency of olivine is significantly enhanced. Although not wishing to be bound by theory, the inventor postulates that this increased coating-removal efficiency of olivine that has been pretreated with heat and water may be due to the enhanced friability of treated olivine verses untreated olivine.

The particulate cleaning medium 17 may tend to clump together when wet, and therefore, the system 10 of embodiments of the present invention preferably maintains the particulate cleaning medium 17 in a substantially dry state until mixing with the heated water 21 is desired. More particularly, the amount of water present in the hopper 26 is preferably maintained at less than 5 percent by weight of the particulate cleaning medium 17 in the hopper 26, more preferably less than 2 percent by weight of the particulate cleaning medium 17 in the hopper 26, and most preferably less than 1 percent by weight of the particulate cleaning medium 17 in the hopper 26. Accordingly, the hopper 26 for storage of the particulate cleaning medium 17 is preferably sealed to prevent moisture contamination.

The hopper 26 includes a cone 28 fluidly connected to the mixing valve 22. An angle of the cone 28 ranges from 20°-80°, more preferably 30°-70°, and most preferably 40°-60°. In embodiments of the present invention, the cone angle can be either 450 or 600. If the cone angle is 45°, the particulate cleaning medium 17 does not flow easily through the cone 28, and therefore, a vibrator (not shown), such as a pneumatic vibrator, may be mounted to the cone 28 to assist in the flow of the particulate cleaning medium 17 therethrough. Applicant has found that with a 600 cone 28, the particulate cleaning medium 17 flows through the cone 28 sufficiently.

The compressed air source 18 provides compressed air 19 to the mixing valve 22. In embodiments of the present invention, the compressed air source 18 comprises a compressor 30 mounted on the frame 24. Alternatively, the system 10 of embodiments of the present invention could employ a compressor already located at a work site or otherwise supplied by a user. Preferably, the compressor 30 has a volume of at least 10-400 cubic feet per minute (cfm), more preferably 25-250 cfm, and most preferably 45-185 cfm. The compressed air source 18 provides compressed air 19 to the valve 22 via an air delivery hose 32 fluidly connected between the compressed air source 18 and the valve 22. The compressor 30 preferably provides compressed air 19 to the mixing valve at a pressure of 5-150 psi, more preferably 10-80 psi, and most preferably 20-50 psi. In certain embodiments, the pressure of the compressed air provided to the mixing valve is less than 50 psi or less than 40 psi.

The heated water source 20 can embody various forms sufficient to provide heated water 21 to the valve 22. The heated water source 20 can optionally include an internal heater 34. Alternatively, the heated water 21 in the heated water source 20 can be heated prior to entering the heated water source 20. The heated water 21 preferably has a temperature of 50°-200° F., more preferably 60°-150° F., and most preferably 70°-130° F. In certain embodiments it is preferred for the heated water 21 to have a temperature of at least 75° F., at least 90° F., or at least 100° F.

In embodiments of the present invention, the system 10 may be connected to a remote source of water, such as a water spigot on a building. The water source 20 may then be connected to a water heater 34 mounted on the frame 24. The water heater 34 heats the water 21, and the heated water 21 is then supplied to the valve 22 via a water delivery hose 36. In alternative embodiments of the present invention, the heated water source 20 comprises at least one water tank (not shown) mounted on the frame 24. Heated water 21 is supplied to the tank at a beginning of each operating period for the system 10, such as at the beginning of a work day. The water tank is insulated to maintain the water's preferred temperature. Applicant has found that with proper insulation, the insulated water tank can maintain the heated water's temperature for 8-10 hours depending on the ambient air temperature. An even further alternative for the heated water source 20 could be the water tank mounted on the frame 24 but with the water 21 stored therein unheated. The water 21 would then be heated with the water heater 34, also mounted on the frame 24, on an as-need basis. This alternative would be advantageous in locations where a remote water source is inaccessible or refilling with heater water impractical. In certain embodiments, a surfactant can be added to the water 21 prior to combining the water with the particulate cleaning medium. If a surfactant is used, it can be present in an amount up to about 10 weight percent, based on the weight of the water.

Figure 2:
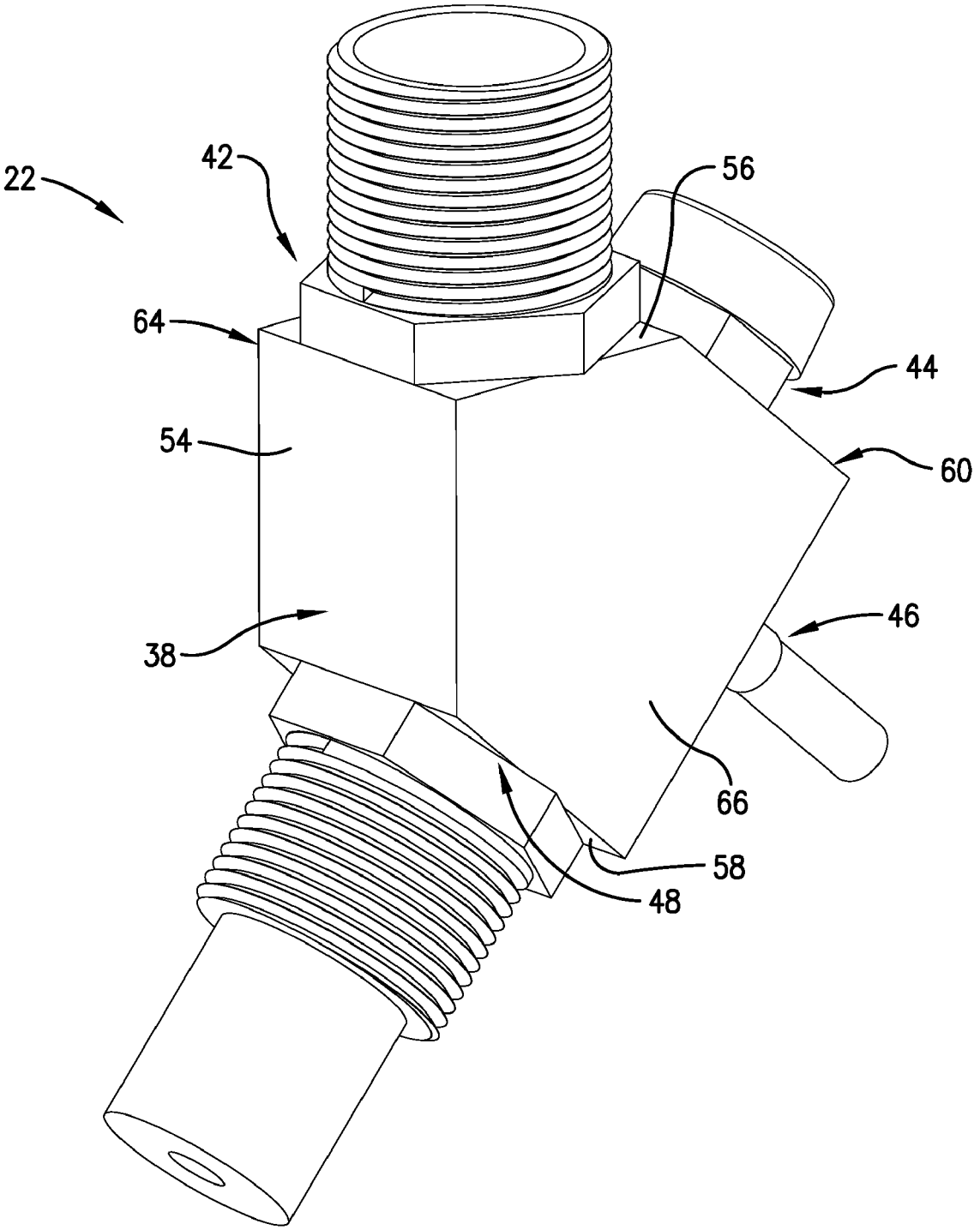
FIG. 2 is a perspective view of a mixing valve of the system of embodiments of the present invention.
Figure 3:
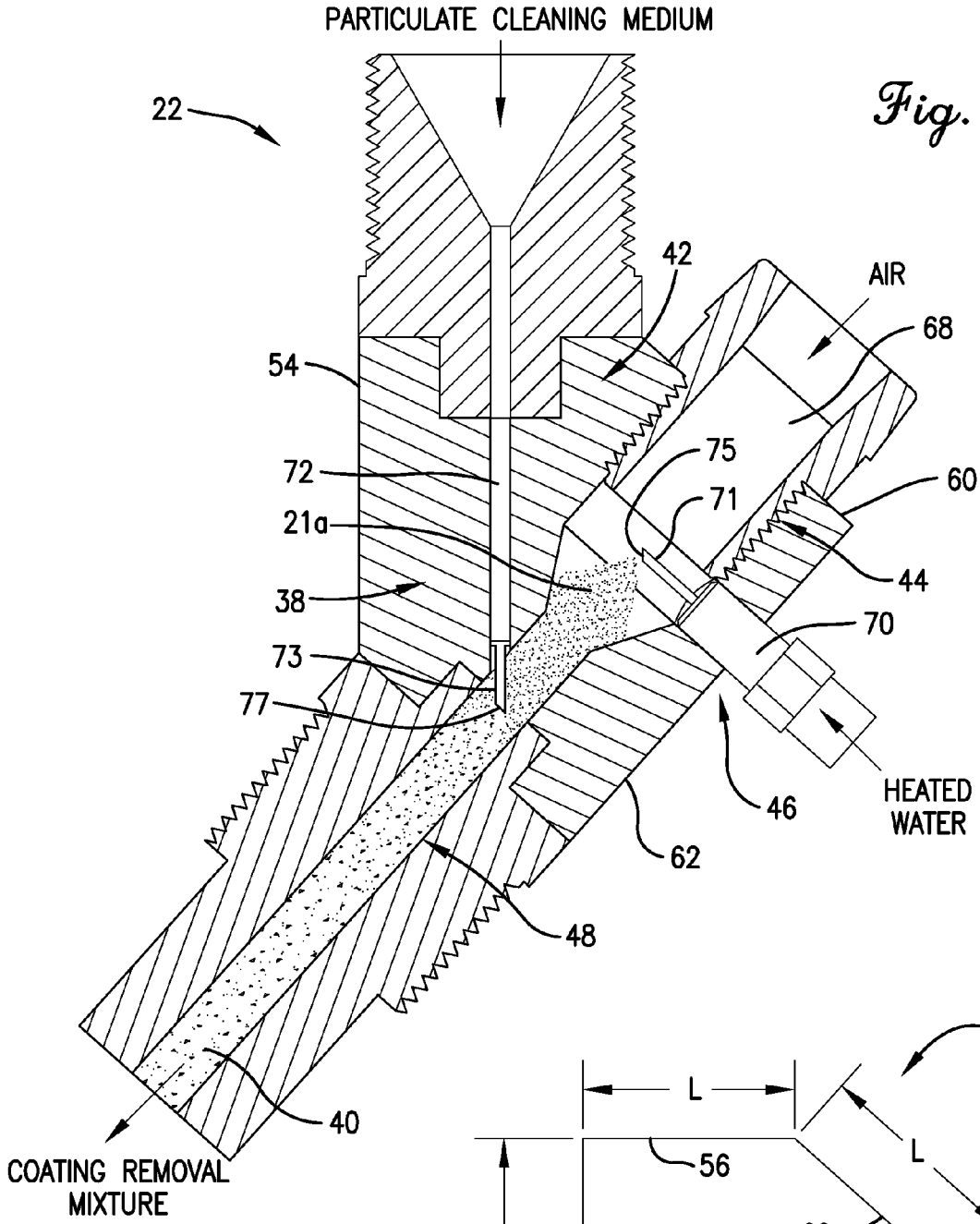
FIG. 3 is a vertical cross-sectional view of the valve of FIG. 2.
Figure 4:
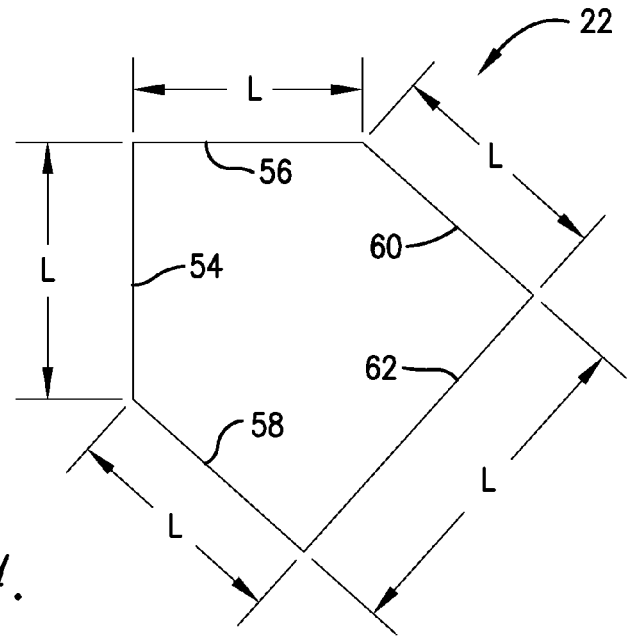
FIG. 4 is a plan view of the mixing valve of FIG. 2 and illustrating certain dimensions.

Referring to FIGS. 2-4, the mixing valve 22 of embodiments of the present invention comprises a body 38, a mixing chamber 40 housed within the body 38, a compressed air input 44 fluidly coupled with and disposed between the compressed air source 18 and the mixing chamber 40, a heated water input 46 fluidly coupled with and disposed between the heated water source 20 and the mixing chamber 40, a particulate cleaning medium input 42 fluidly coupled with and disposed between the particulate cleaning medium source 16 and the mixing chamber 40, and an output 48 fluidly coupled with and disposed between the mixing chamber 40 and a nozzle 50 for dispersion of a coating removal mixture 52 onto the coating 12 and the substrate 14.

Referring to FIG. 2, the valve body 38 is preferably generally house-shaped and includes a left-angled upper wall 54, a right-angled upper wall 56, a left side wall 58, a right side wall 60, a lower wall 62, a back wall 64, and a front wall 66.

The compressed air input 44 is positioned on the right side wall 60, the heated water input 46 is positioned on the lower wall 62, and the output 48 is positioned on the left side wall 58, the particulate cleaning medium input 42 is preferably positioned on the right-angled upper wall 56. In operation, the valve 22 is preferably oriented such that the particulate cleaning medium input 42 is generally positioned upwards and vertical.

Referring to FIG. 3, the valve 22 further includes a first conduit 68 formed within the body 38, a second conduit 70 formed within the body 38 and in fluid communication with the first conduit 68, and a third conduit 72 formed within the body 38 and in fluid communication with the first conduit 68.

Each of the conduits 68,70,72 is in fluid communication with the mixing chamber 40. As such, the first conduit 68 is fluidly coupled with and disposed between the compressed air input 44 and the mixing chamber 40, the second conduit 70 is fluidly coupled with and disposed between the heated water input 46 and the first conduit 68, and the third conduit 72 is fluidly coupled with and disposed between the particulate cleaning medium input 42 and the first conduit 68. The first conduit 68 is then fluidly coupled to the mixing chamber 40, such that each of the conduits 68,70,72 delivers its respective material (air, water, or particulate cleaning medium) to the mixing chamber 40. It is to be appreciated that because the first conduit 68 is in fluid communication with the mixing chamber 40, alternative embodiments of the present invention could define at least a portion of the mixing chamber 40 including at least a portion of the first conduit 68, such that the third conduit 72 intersects the mixing chamber 40, as opposed to the first conduit 68.

As best illustrated in FIG. 3, the first conduit 68 is preferably oriented 0°-90° above horizontal, more preferably 20°-80° above horizontal, and most preferably 40°-60° above horizontal. In the embodiment illustrated in FIG. 3, the first conduit 68 is oriented approximately 45° above horizontal. Similarly, the second conduit 70 is preferably oriented 00-900 below horizontal, more preferably 20°-80° below horizontal, and most preferably 40°-60° below horizontal. In the embodiment illustrated in FIG. 3, the second conduit 70 is oriented approximately 45° below horizontal. More particularly, the second conduit 70 preferably intersects the first conduit 68 at an approximately 90° angle, such that the second conduit 70 is generally perpendicular to the first conduit 68. As also illustrated in FIG. 3, the third conduit 72 is preferably oriented approximately vertically, such that the third conduit 72 intersects the first conduit 68 at an approximately 45° angle.

As illustrated in FIG. 3, the mixing chamber 40 is a continuation of the third first conduit 72. In certain embodiments, the mixing chamber 40 includes a downwardly sloped section that is located downstream where the particulate clean medium 17 is introduced into the mixing chamber 40. This downwardly sloped portion of the mixing chamber 40 can be oriented 100-80° below horizontal, more preferably 20°-70° below horizontal, and most preferably 30°-60° below horizontal.

Due to the positioning and orientation of the conduits 68,70,72, the compressed air 19 first enters the valve body 38 via the compressed air input 44 and the first conduit 68. The heated water 21 is then provided to the compressed air 19 via the heated water input 46, the second conduit 70, and an atomizing injector 71. The atomizing injector 71 is operable to inject the heated water 21 into the mixing chamber 40 as atomized water 21*a*. The atomizing injector 71 can include a discharge opening 75 for discharging atomized water into the mixing chamber 40. This discharge opening 75 preferably has an open area of less than 0.001 $in^2$, more preferably less than 0.0005 $in^2$, and most preferably less than 0.0001 $in^2$. In the embodiment illustrated in FIG. 3, the atomizing injector 71 is an injection quill that extends into the mixing chamber 40 and discharges atomized water 21 at about the center of the mixing chamber 40 so as to form a compressed air and water mixture. The particulate cleaning medium 17 is then provided to the compressed air and water mixture via the particulate cleaning medium input 42, the third conduit 72, and a particulate cleaning medium injector 73. The particulate cleaning medium injector 73 is operable to inject the particulate cleaning medium 17 into the mixing chamber. The particulate cleaning medium injector 73 can include a discharge opening 77 for discharging particulate cleaning medium 17 into the mixing chamber 40. This discharge opening 77 preferably has an open area of less than 0.01 $in^2$, more preferably less than 0.005 $in^2$, and most preferably less than 0.001 $in^2$. In the embodiment illustrated in FIG. 3, the particulate cleaning medium injector 73 is an injection quill that extends into the mixing chamber 40 and discharges the particulate cleaning medium at about the center of the mixing chamber so as to provide the coating removal mixture 52 that is mixed within the downwardly sloped section of mixing chamber 40. As such, the water 21 mixes with the air 19 to provide the water and air mixture prior to mixing with the particulate cleaning medium 17. Further, the particulate cleaning medium input 42, the compressed air input 44, and the water input 46 are positioned on the valve 22, such that the water input 46 is positioned downstream of the compressed air input 44, and the particulate cleaning medium input 42 is positioned downstream of both the compressed air and water inputs 44,46. Although not illustrated in FIG. 3, mixing valve 22 can be equipped with control mechanisms for controlling the rate of introduction of the heated water 21 and particulate cleaning material 17 into the mixing chamber.

As discussed in more detail below, once mixed within the mixing chamber 40, the coating removal mixture 52 is dispersed onto the substrate 14. The coating removal mixture exits the output 48. As illustrated in FIG. 1, the output 48 is connected to the nozzle 50 via a mixture delivery hose 74.

The frame 24 of the system 10 can embody various forms depending on a desired mobility of the system 10. As such, the frame 24 could be a platform (not shown) fixedly mounted to a factory floor, for example. Alternatively, the frame 24 could be mounted to a platform (not shown) having slots for forklift tines for moving of the system 10 to various locations. An even further alternative could employ a frame 24 having a lifting ring (not shown) or four point harness (not shown) for hoisting of the system 10 onto a roof or for use while suspended from a crane. However, as can be appreciated, most uses of the system 10 of embodiments of the present invention will require a mobile frame 24 that can be moved to a work site. Therefore, the frame 24 could be towed behind a vehicle or could be self-propelled, such as mounted to or within the bed of a vehicle. Preferably, the frame 24 is sized to have mounted thereon the particulate cleaning medium source 16, including the hopper 26, the compressed air source 18, including the compressor 30, the heated water source 20, including the at least one water tank, if used, and the water heater 34, the valve 22, and the hoses. The frame 24 is preferably formed of aluminum, steel, or other durable material capable of receiving the weight of the above-listed components. The particulate cleaning medium source 16, including the hopper 26 and the mixing valve 22 may also be mounted upon wheels. When removed from frame 24 it would be free and separately mobile, thereby extending its reach and allowing access to areas that the frame mounted option will not allow. The air delivery hose 32 would be attached to the mixing valve 22, the heated water source 20 would be a connected by water delivery hose 36.

In operation, a user of the system 10 connects the air delivery hose 32 to the compressed air source 18 and the compressed air input 44. Similarly, the user connects the water delivery hose 36 to the heated water source 20 and the heated water input 46, and the mixture delivery hose 74 to the output 48 and the nozzle 50. The user also connects the hopper 26 to the particulate cleaning medium input 42 and fills the hopper 26 with the particulate cleaning medium 17.

Referring to FIG. 5, to begin operation, compressed air 19 is supplied to the first conduit 68, where, as discussed above, heated water 21 mixes with the compressed air 19. The particulate cleaning medium 17 is then supplied to the air and water mixture, which mixes to become the coating removal mixture 52. Due to the angle between the first and third conduits 68,72, the particulate cleaning medium 17 is added to the air and water mixture at an angle, which assists in mixing of the particulate cleaning medium 17, air 19, and water 21 and helps resist clumping of the particulate cleaning medium 17 once mixed with the water 21. Furthermore, once the system 10 is shut down, the angle of the first conduit 68 assists in preventing clogging of the output 48.

Embodiments of the present invention contemplate using a significantly larger volume of air 19 to water 21 and air 19 to the particulate cleaning medium 17 than prior art systems. In particular, embodiments of the present invention provide for a volumetric ratio of air 19 to water 21 of at least 150:1, at least 300:1, at least 500:1, at least 1,000:1, at least 5,000:1, or at least 10,000:1. Embodiments of the present invention also provide for a volumetric ratio of air 19 to the particulate cleaning medium 17 of at least 200:1, at least 300:1, at least 450:1, at least 1,000:1, at least 5,000:1, or at least 10,000:1. Embodiments of the present invention further provide for a volumetric ratio of the particulate cleaning medium 17 to water 21 of 0.1:1-10:1, more preferably 0.4:1-5:1, and most preferably 0.6:1-1.5:1. In one embodiment of the present invention, the volumetric ratio of air 19 to water 21 is 500:1-5,000:1 and the volumetric ratio of air 19 to particulate cleaning material 17 is 450:1-5,000:1.

Applicant has found that use of the system 10 of embodiments of the present invention provides a coating removal system 10 with an efficient coating removal mixture that produces significantly less material waste, including water 21 and the particulate cleaning medium 17, than prior art systems. Because such little water 21 and particulate cleaning medium 17 is used, the system 10 outputs very little waste (i.e., excess) water. Therefore, the system 10 can be used in interior spaces where waste water is undesired. Additionally, the system 10 operates at a low pressure, which lessens the potential for harming the substrate 14 and the amount and distance of debris travel. In fact, during operation, it is relatively difficult to visually detect whether or not the coating removal mixture 52 is exiting the nozzle 50 due to the low pressure and the low volumes of water 21 and particulate cleaning medium 17 used in the operation of the system 10.

Although the invention has been described with reference to the embodiments illustrated in the attached drawing figures, it is noted that equivalents may be employed and substitutions made herein without departing from the scope of the invention as recited in the claims.

The preferred forms of embodiments of the present invention described above are to be used as illustration only and should not be used in a limiting sense to interpret the scope of the present invention. Modifications to the exemplary embodiments, set forth above, could be readily made by those skilled in the art without departing from the spirit of embodiments of the present invention.

The invention claimed is:

1. A method for removing a coating from a substrate, the method comprising:

(a) separately introducing compressed air, water, and a particulate cleaning medium into a mixing valve, wherein said particulate cleaning medium is maintained in a substantially dry state prior to introduction into the mixing valve;

(b) combining the compressed air, water, and particulate cleaning medium to thereby provide a coating removal mixture wherein the volumetric ratio of air to water in the coating removal mixture is at least 150:1, wherein the volumetric ratio of air to particulate cleaning medium in the coating removal mixture is at least 200:1; and (c) dispersing the coating removal mixture onto the coating and substrate to thereby remove the coating from the substrate.

2. The method of claim 1, wherein said particulate cleaning medium comprises olivine.

3. The method of claim 1, wherein the volumetric ratio of water to particulate cleaning medium in the coating removal mixture is 0.1:1-10:1.

4. The method of claim 3, wherein the volumetric ratio of air to water in the coating removal mixture is at least 300:1, wherein the volumetric ratio of air to particulate cleaning medium in the coating removal mixture is at least 300:1.

5. The method of claim 4, wherein said particulate cleaning medium comprises olivine.

6. The method of claim 5, wherein the volumetric ratio of air to water in the coating removal mixture is at least 500:1, wherein the volumetric ratio of air to particulate cleaning medium in the coating removal mixture is at least 450:1, wherein the volumetric ratio of water to particulate cleaning medium in the coating removal mixture is 0.4:1-5:1.

7. The method of claim 1, further comprising transferring the particulate cleaning medium from a particulate cleaning medium source to the mixing valve, wherein the amount of water transferred from the particulate cleaning medium source to the mixing valve along with the particulate cleaning medium is less than 5 percent by weight of the particulate cleaning medium.

8. The method of claim 1, further comprising the step of heating the water prior to combining the water with the compressed air and the particulate cleaning medium.

9. The method of claim 1, wherein the water has a temperature of at least 90° F. when combined with the compressed air and particulate cleaning medium, wherein the compressed air has a pressure of 10-80 psi when combined with the water and particulate cleaning medium.

10. The method of claim 1, wherein the compressed air has pressure of less than 40 psi when combined with the water and particulate cleaning medium.

11. The method of claim 1, wherein the average particle size of the particulate cleaning medium is 50-250:, wherein the hardness of the particulate cleaning is 5-10 on the Moh scale.

12. The method of claim 7, wherein the particulate cleaning medium source comprises a hopper that is sealed to prevent moisture from entering therein.

13. The method of claim 1, wherein the combining of step (b) includes first combining the compressed air and the water to form an air/water mixture and then combining the particulate cleaning medium with the air/water mixture to provided the coating removal mixture.

14. The method of claim 1, wherein the water is in an atomized form when combined with the compressed air and the particulate cleaning medium.

15. A method of removing a coating from a substrate, the method comprising:

(a) separately introducing compressed air, water, and a particulate cleaning medium into a mixing valve;

(b) combining the compressed air and water at a first location in said mixing valve to thereby form an air/water mixture;

(c) combining the air/water mixture with the particulate cleaning medium at a second location in the mixing valve downstream of the first location to thereby form a coating removal mixture; and (d) dispersing the coating removal mixture onto the coating and substrate to thereby remove the coating from the substrate.

16. The method of claim 15, further comprising atomizing the water prior to combination with the air.

17. The method of claim 15, further comprising heating the water prior to combination with the air.

18. The method of claim 15, further comprising maintaining the particulate cleaning medium in a substantially dry state prior to combination with the air/water mixture.

19. The method of claim 15, wherein the mixing valve comprises an atomizing injector supplying the water in atomized form to the first location, wherein the atomizing injector discharges water through a discharge opening having an open area less than 0.0005 square inches.

20. The method of claim 15, wherein the mixing valve comprises a particulate cleaning medium injector supplying the particulate cleaning medium to the second location, wherein the particulate cleaning medium injector discharges the particulate cleaning medium through a discharge opening having an open area of less than 0.005 square inches.

21. The method of claim 15, wherein the compressed air passes through at least a portion of the mixing valve at a downward angle in the range of 20 to 80° from horizontal.

22. The method of claim 15, wherein the volumetric ratio of air to water in the coating removal mixture is at least 150:1, wherein the volumetric ratio of air to particulate cleaning medium in the coating removal mixture is at least 200:1.

23. The method of claim 15, further comprising, prior to step (b), heating the water to a temperature of at least 60° F., wherein the compressed air is supplied to the first location at a rate of at least 25 cubic feet per minute, wherein the average particle size of the particulate cleaning medium is 50-250μ.

24. The method of claim 15, wherein the particulate cleaning medium comprises olivine.

25. The method of claim 15, further comprising transporting the air from an air compressor to the mixing valve, further comprising transporting the water from a water tank to the mixing valve, further comprising transporting the particulate cleaning medium from a hopper to the mixing valve, wherein the air compressor, water tank, hopper, and mixing valve are all coupled to a common frame, further comprising using a vehicle to transport the common frame to multiple work locations.

* * * * *